US006193467B1

(12) United States Patent
Chang

(10) Patent No.: US 6,193,467 B1
(45) Date of Patent: Feb. 27, 2001

(54) DRIVEN UNIT, ESPECIALLY FOR USE IN A CROSS FLOW FAN

(75) Inventor: Shun-Chen Chang, Taoyuan Shien (TW)

(73) Assignee: Delta Electronics, Inc., Taoyuan Shien (TW)

( * ) Notice: Subject to any disclaimer, the term of this patent is extended or adjusted under 35 U.S.C. 154(b) by 0 days.

(21) Appl. No.: 09/267,793

(22) Filed: Mar. 12, 1999

(30) Foreign Application Priority Data

Oct. 9, 1998 (TW) ..... 87216769

(51) Int. Cl.[7] ..... F04D 29/26

(52) U.S. Cl. ..... 416/170 R; 416/220 A; 464/184; 415/53.1

(58) Field of Search ..... 415/53.1, 53.2, 415/53.3; 416/170 R, 220 A, 220 R, 244 R; 464/179, 182, 184

(56) References Cited

U.S. PATENT DOCUMENTS 3,241,742 * 3/1966 Laing ..... 415/53.1
3,694,881 * 10/1972 Glucksman ..... 416/178
3,885,127 * 5/1975 Walter et al. ..... 415/102

FOREIGN PATENT DOCUMENTS

0356314 * 2/1990 (EP) .

* cited by examiner

*Primary Examiner*—Edward K. Look
*Assistant Examiner*—Liam McDowell
(74) *Attorney, Agent, or Firm*—Skjerven Morrill MacPherson LLP; Alan H. MacPherson

(57) ABSTRACT

A driven unit driven adapted to be used in a cross fan is provided. The driven unit is driven by a motor. The main feature of the driven unit is that there is a concave region on the surface of its rotary shaft. The elastic rubber cap is embedded in the concave region and the embedded portion of the rubber cap can tightly connect the rotary shaft with the rubber cap. Therefore, the blades sleeved on the rotary shaft can be fixed in the right position without shifting. The cross fan having the driven unit of the present invention will have a relatively longer useful life.

2 Claims, 3 Drawing Sheets

DRIVEN UNIT, ESPECIALLY FOR USE IN A CROSS FLOW FAN

FIELD OF THE INVENTION

The present invention relates to a driven unit, and especially to a driven unit adapted to be used in a fan.

BACKGROUND OF THE INVENTION

The electric fan is a very important machine in our daily life. Computers, air conditioners, hair-blowers and the like all have electric fans inside. The blades of most electric fans are disc blades. When the disc blades are rotated, a columnar current vertical to the surface of blades will be generated. However, there are other kinds of electric fans, such as cross fan. The cross fan is substantially columnar and rotated along its axial direction of the column. When the cross fan is rotated, a planar surface of air current, a so-called air wall, will be generated. The cross fan is usually disposed on the top of the automatic door of a convenience store.

Conventionally, the blades are sleeved on a rotary shaft and a rubber cap is set at the end of the shaft to support the blades to be rotated together. However, because the surface of the rotary shaft is smooth, the rubber cap can easily slide from one place to another so that the rotation of the blades will be retarded and blocked by other elements.

To solve this problem, the rubber cap usually is agglutinated with the rotary shaft by an adhesive agent to ensure that the rubber is properly fixed on the rotary shaft, but this method is not good enough. The adhesive agent cannot be effectively attached on the smooth surface of the rotary shaft and after the shaft is rotated for a while, the heat generated by rotation will undo the adhesive agent, resulting in that the rubber cap cannot be fixed on the shaft. Consequently, the blades cannot rotate effectively and the cross fan will fail.

It is therefore attempted by the applicant to deal with the above situation encountered with the prior art.

SUMMARY OF THE INVENTION

An object of the present invention is to provide a driven unit. The driven unit is adapted to be used in a cross fan and driven by a prime mover. The driven unit includes a rotary shaft, a rotary member, and a fixing medium. The rotary shaft is coaxially mounted to the prime mover and rotated along an axial direction by the prime mover. There is a concave region on a peripheral surface of the rotary shaft for securing the fixing medium thereon. After the rotary member is sleeved on the rotary shaft, the fixing medium is mounted on the rotary shaft subsequently for preventing the rotary member from shifting. Therefore, the rotary member can be rotated properly along the axial direction by the rotary shaft. Because the fixing medium is secured in the concave region on the surface of the rotary shaft, the rotary member can be effectively rotated.

According to the present invention, the prime mover is a motor and the concave region can be a concave ring around the shaft, a plurality of screw threads, or notches. The fixing medium is an elastic cap, especially a rubber cap, so that the cap can be embedded in the concave region of the rotary shaft to prevent the rotary member from shifting on the rotary shaft.

The present invention may best be understood through the following description with reference to the accompanying drawings, in which:

DETAILED DESCRIPTION OF THE PREFERRED EMBODIMENTS

Figure 1:
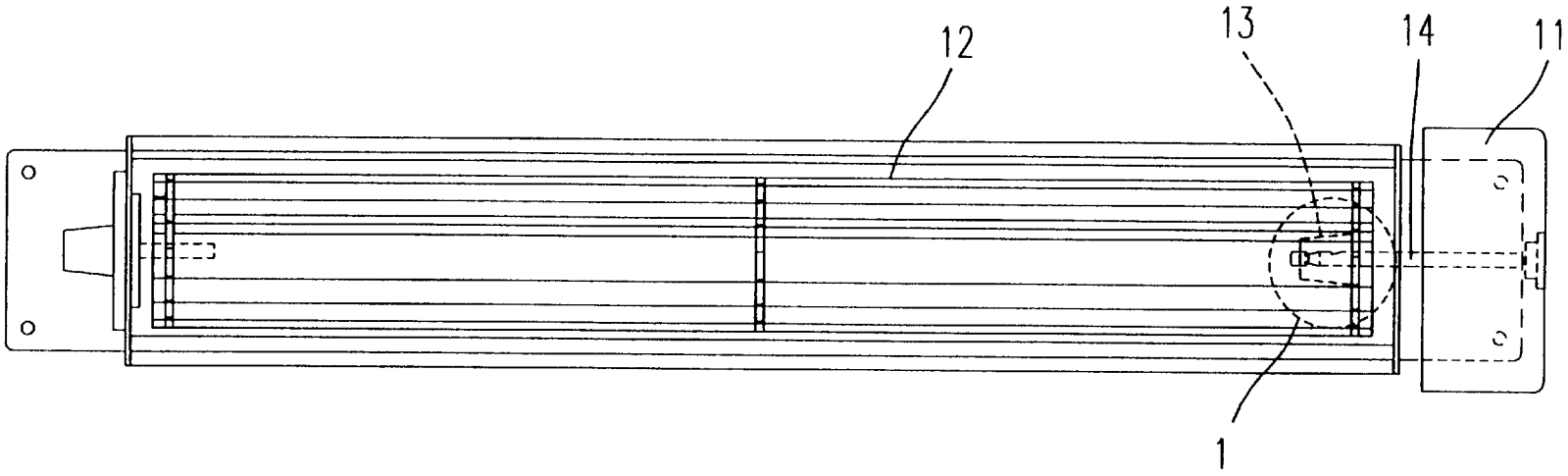
FIG. 1 schematically shows the cross fan combined with a driven unit of the present invention.
Figure 2:
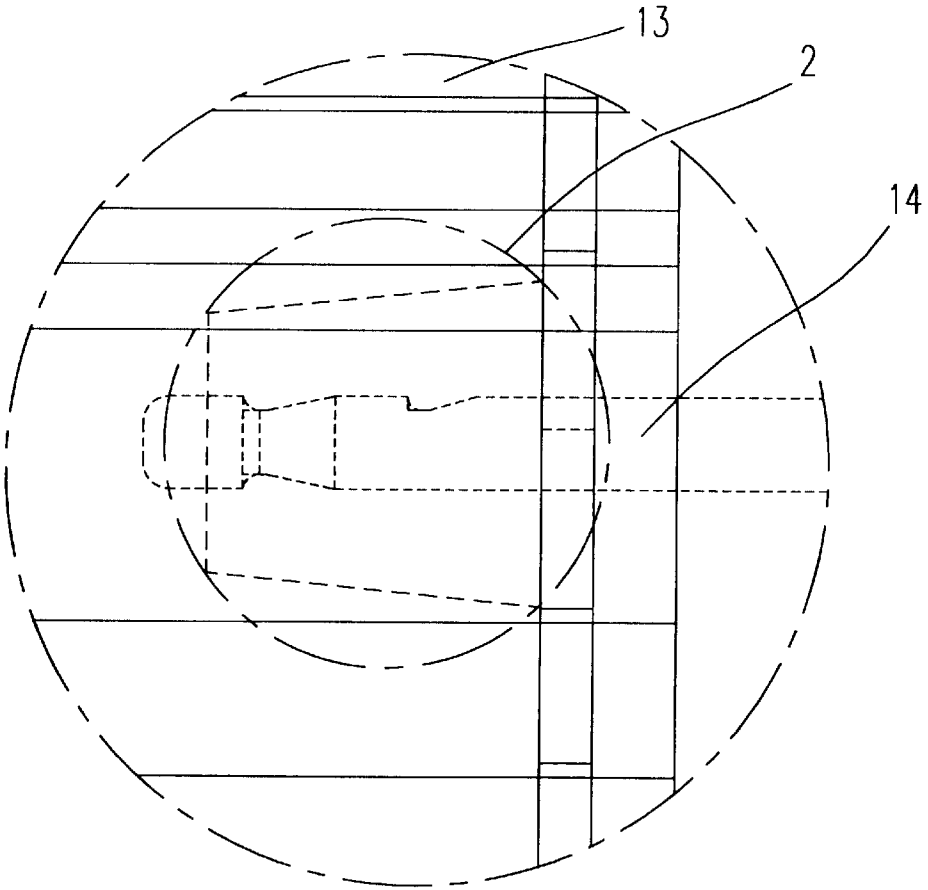
FIG. 2 is an amplified diagram of part 1 in FIG. 1 according to the present invention.
Figure 3:
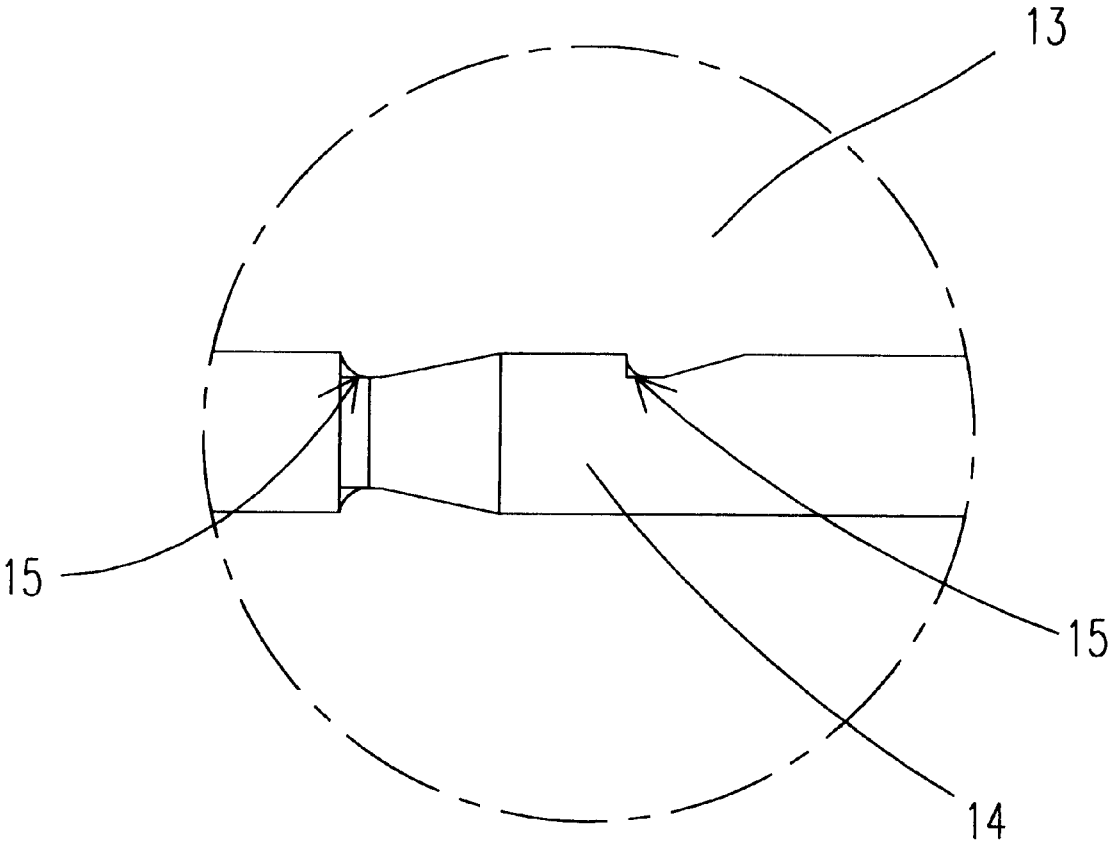
FIG. 3 is an amplified diagram of part 2 in FIG. 2 according to the present invention.

Please refer to FIG. 1 schematically showing the cross fan combined with a driven unit of the present invention. FIG. 2 and FIG. 3 are the amplified diagrams of the driven unit according to the present invention. The fixing medium 13 is sleeved on the rotary shaft 14 to connect the rotary member 12 having a plurality of blades with the rotary shaft. In comparison with the conventional rotary shaft, the rotary shaft 14 of the present invention has a concave region 15 on the peripheral surface of the rotary shaft for securing the fixing medium 13 to be fixed on the rotary shaft. As shown in FIG. 3, the concave region 15 can be any different type. It can be a notch, a concave ring around the shaft, or a plurality of screw threads. The fixing medium 13 is made by an elastic material to be embedded in the concave region 15. The fixing medium 13 is preferably a rubber cap because the rubber cap is elastic and cheap. Therefore, the fixing medium 13 mounted on the rotary shaft 14 can fix the rotary member 12 effectively so that the rotary member can be rotated by the rotary shaft 14 properly along the axial direction.

The portion of the rubber cap embedded in the concave region can provide a tight connection between the rotary shaft and the rubber cap. This connection can effectively prevent sliding of the rubber cap and shifting of the rotary member. As a result, the blades are rotated properly at their right positions without rubbing the elements aside. This improvement effectively elongates the useful life of the cross fan.

In addition, the rotary shaft of the present invention can be easily manufactured. No other elements or devices have to be added, but only a step of producing the concave region on the rotary shaft is required. This step is easy for all factories. Therefore, the cross fan having a driven unit of the invention can have a better quality without increasing the cost.

While the invention has been described in terms of what are presently considered to be the most practical and preferred embodiments, it is to be understood that the invention need not be limited to the disclosed embodiment. On the contrary, it is intended to cover various modifications and similar arrangements included within the spirit and scope of the appended claims which are to be accorded the broadest interpretation so as to encompass all such modifications and similar structures.

What is claimed is:

1. A driven unit driven by a prime mover comprising:

a rotary shaft coaxially mounted to said prime mover and rotated along an axial direction by said prime mover, said rotary shaft having a concave region on a peripheral surface of said rotary shaft;

a rotary member sleeved on said rotary shaft and rotated along said axial direction by said rotary shaft; and a fixing medium mounted on said rotary shaft and between said rotary shaft and said rotary member, said fixing medium comprising a cap of an elastic material embedded in said concave region for preventing said rotary member from shifting on said rotary shaft.

2. The driven unit according to claim 1, wherein said elastic material is rubber.

* * * * *